US006650311B1

(12) United States Patent
Mori

(10) Patent No.: US 6,650,311 B1
(45) Date of Patent: Nov. 18, 2003

(54) CONTROL OF VIDEO SIGNAL INVERSION FREQUENCY INDEPENDENTLY OF FRAME OR FIELD FREQUENCY

(75) Inventor: Shigeki Mori, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/178,423

(22) Filed: Oct. 26, 1998

(30) Foreign Application Priority Data

Oct. 27, 1997 (JP) ..... 9-294471

(51) Int. Cl.[7] ..... G09G 3/36
(52) U.S. Cl. ..... 345/96; 345/95
(58) Field of Search ..... 345/94–100

(56) References Cited

U.S. PATENT DOCUMENTS 4,110,967 A * 9/1978 Fujita ..... 345/94
4,989,092 A * 1/1991 Doyle et al. ..... 358/140
5,119,219 A 6/1992 Terada et al. ..... 359/56
5,574,516 A * 11/1996 Kanai et al. ..... 348/742
5,742,369 A 4/1998 Mihara et al. ..... 349/123
5,844,538 A * 12/1998 Shiraki et al. ..... 345/98
5,844,619 A * 12/1998 Songer ..... 348/447
6,014,126 A * 1/2000 Nishihara ..... 345/132
6,243,064 B1 * 6/2001 Hirakata ..... 34/96
6,295,043 B1 * 9/2001 Hashimoto et al. ..... 345/96

FOREIGN PATENT DOCUMENTS

EP 0686958 A1 12/1995
JP 2-253321 10/1990

* cited by examiner

*Primary Examiner*—Amare Mengistu
*Assistant Examiner*—David L Lewis
(74) *Attorney, Agent, or Firm*—Fitzpatrick, Cella, Harper & Scinto

(57) ABSTRACT

A liquid crystal display apparatus having a circuit substrate carrying thereon a plurality of pixel electrodes, a counter substrate carrying thereon a corresponding counter electrode disposed vis-a-vis the pixel electrodes and a liquid crystal layer held between the circuit board and the counter substrate and adapted to be controlled by the voltage applied between the pixel electrodes and the counter electrode is characterized in that it comprises a field frequency conversion means for multiplying the field frequency of the video signals input to the respective pixel electrode by a (a>1) and a switching means for changing over from the inversion of the polarity of the video signal output from said field frequency conversion means by every field to the inversion of the polarity of the video signal output from said field frequency conversion means by every n fields (n being a positive integer not equal to 1) or vice versa.

4 Claims, 5 Drawing Sheets

CONTROL OF VIDEO SIGNAL INVERSION FREQUENCY INDEPENDENTLY OF FRAME OR FIELD FREQUENCY

BACKGROUND OF THE INVENTION

1. Field of the Invention

This invention generally relates to a liquid crystal display apparatus and, more particularly, it relates to a liquid crystal display apparatus having a characteristic feature in the supply of video signals to the pixel electrodes of the circuit board.

2. Related Background Art

FIG. 1 of the accompanying drawings schematically shows a cross sectional view of a known liquid crystal panel. Since liquid crystal gives rise to a sticking phenomenon when a DC voltage is applied thereto, the polarity of the electric field being applied to the liquid crystal has to be inverted alternately on a field period by field period basis. For example, pixel M1 being subjected to an electric field that is directed upwardly from the pixel electrode toward the counter electrode in FIG. 1 in the current field period is then subjected to a downwardly directed electric field in the next field period to take over the current part of pixel M2 and then to an upwardly directed electric field in the following field period to resume the current part and so on. However, if the voltage applied to the liquid crystal is displaced from the proper polarity as shown in FIG. 2, a DC voltage is applied to the liquid crystal to make up the displacement to consequently give rise to a sticking phenomenon. Therefore, in order to avoid sticking, the counter potential has always to be located at the center of the amplitude of the pixel potential.

On the other hand, the brightness of a liquid crystal display apparatus depends on the absolute value of the electric field applied to the liquid crystal and does not relate to its polarity. Thus, if the counter potential is displaced from the center of the amplitude of the pixel potential, the electric field shows a difference in the absolute value of the electric field between when it is positive and when it is negative to become bright and dark alternately field period by field period. Referring to FIG. 4, if the counter potential is made to agree with the center of the incoming video signal typically by means of an oscilloscope arranged outside the liquid crystal panel, the field through caused by the gate capacitance generated, for example, when the gate of transistor T1 is turned OFF will change the potential of the pixel electrode M11 from that of the video signal written there and such a phenomenon can occur to all the pixels so that it is impossible to solve the above identified problem.

As a conventional technique of avoiding the problem of sticking and flicker, changes in the brightness of the liquid crystal of a liquid crystal panel that occur on a field period by field period basis is visually observed as flicker and the counter potential is regulated to eliminate such flicker. However, with such a technique, it is impossible to completely eliminate flicker from liquid crystal panels manufactured on a mass production basis because the extent to which the counter potential can be regulated is quite limited. With another known technique, a short field period or frame period is used to dissolve the problem of flicker. A very high frequency flicker appears to be smoothed to the eye and would no longer recognized as flicker. Generally, no flicker is noticed by the human eye when the frame rate is 70 Hz or above. Therefore, with this technique, flicker will be visually eliminated if the counter potential is displaced slightly from the center of the pixel potential.

However, there are cases where the problem of sticking cannot be solved by the technique of reducing the field period or the frame period. On the other hand, it is often difficult to correctly regulate the counter potential because the human eye cannot recognize flicker.

In view of the above identified problems, it is therefore the object of the present invention to provide a liquid crystal display apparatus having a simple configuration and adapted to dissolve the above problems.

SUMMARY OF THE INVENTION

According to an aspect of the invention, the above object is achieved by providing a liquid crystal display apparatus having a circuit substrate carrying thereon a plurality of pixel electrodes, a counter substrate carrying thereon a corresponding counter electrode disposed vis-a-vis the pixel electrodes and a liquid crystal layer held between the circuit board and the counter substrate and adapted to be controlled by the voltage applied between the pixel electrodes and the counter electrode, characterized in that it comprises a field frequency conversion means for multiplying the field frequency of the video signals input to the respective pixel electrode by a (a>1) and a switching means for changing over from the inversion of the polarity of the video signal output from said field frequency conversion means by every field to the inversion of the polarity of the video signal output from said field frequency conversion means by every n fields (n being a positive integer not equal to 1) or vice versa.

Preferably, a liquid crystal display apparatus according to the invention further comprises a polarity inverting circuit for inverting the polarity of the video signal input to each of the pixel electrodes, an inversion period control means for controlling the timing of inversion of said polarity inverting circuit and a switching means for changing over from the inversion of the polarity of the video signal output from said field frequency conversion means by every field to the inversion of the polarity of the video signal by every n fields or vice versa.

According to another aspect of the invention, there is provided a liquid crystal display apparatus having a circuit substrate carrying thereon a plurality of pixel electrodes, a counter substrate carrying thereon a corresponding counter electrode disposed vis-a-vis the pixel electrodes and a liquid crystal layer held between the circuit board and the counter substrate and adapted to be controlled by the voltage applied between the pixel electrodes and the counter electrode, characterized in that it comprises a frame frequency conversion means for multiplying the frame frequency of the video signals input to the respective pixel electrode by a (a>1) and a switching means for changing over from the inversion of the polarity of the video signal output from said frame frequency conversion means by every frame to the inversion of the polarity of the video signal output from said frame frequency conversion means by every n frames (n being a positive integer not equal to 1) or vice versa.

According to the invention, the period of the flicker caused by a displacement of the counter potential can be doubled or more than doubled by transforming the input video signal. Additionally, sticking and other problems of the liquid crystal of a liquid crystal display apparatus can be prevented from occurring by applying the driving circuit of a projection type liquid crystal display apparatus to it to prolong the service life of the liquid crystal display apparatus.

DETAILED DESCRIPTION OF THE PREFERRED EMBODIMENTS

First Embodiment

Now, the present invention will be described in greater detail by referring to the accompanying drawings that illustrate preferred embodiments of the invention. A liquid crystal display apparatus has a circuit substrate carrying thereon a plurality of pixel electrodes, a counter substrate carrying thereon a corresponding counter electrode disposed vis-a-vis the pixel electrodes and a liquid crystal layer held between the circuit board and the counter substrate, the circuit substrate being typically an active matrix substrate.

Figure 1:
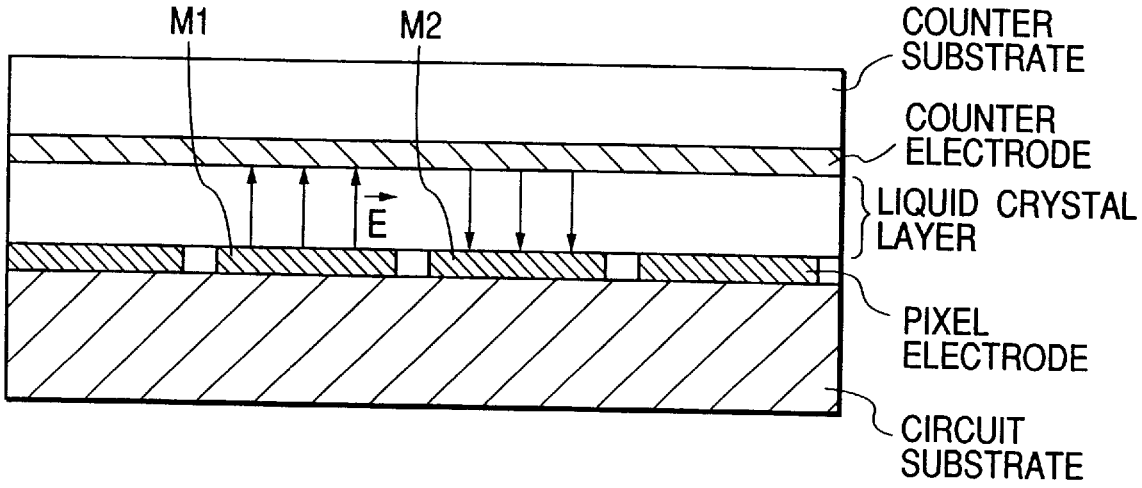
FIG. 1 is a schematic cross sectional view of the liquid crystal panel of a liquid crystal display apparatus according to the invention.
Figure 2:
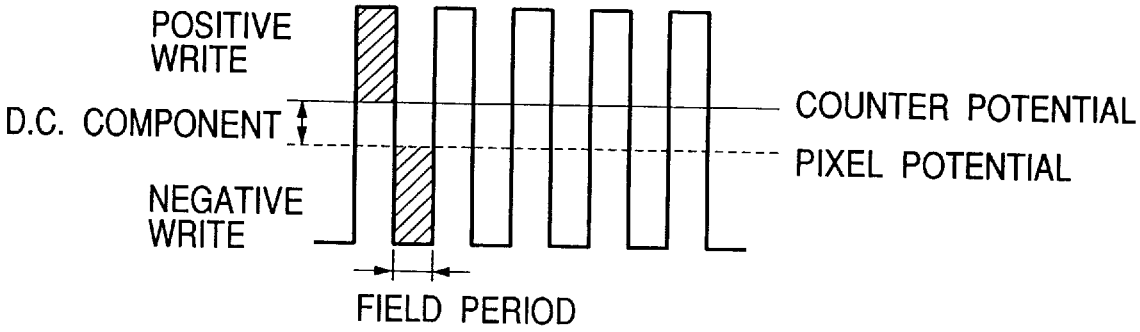
FIG. 2 is a schematic illustration of the waveform of a video signal shown for describing known liquid crystal display apparatus.
Figure 3:
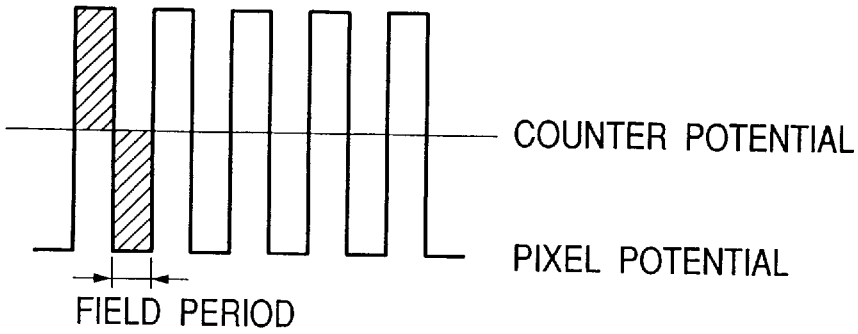
FIG. 3 is a schematic illustration of the waveform of a video signal showing that the counter potential is always located at the center of the amplitude of the pixel potential in a pixel potential display apparatus according to the invention.
Figure 4:
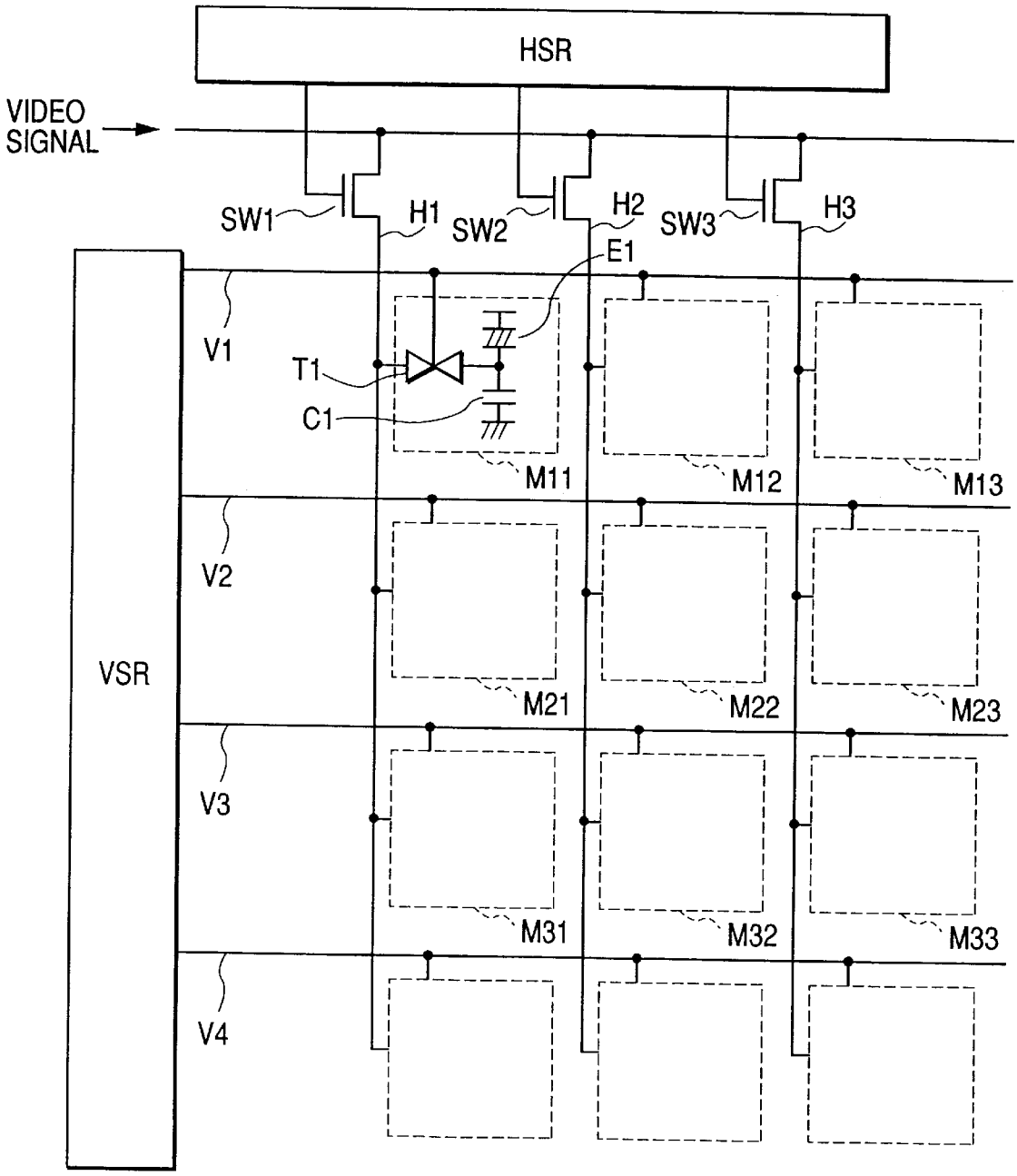
FIG. 4 is a schematic circuit diagram of the active matrix substrate of a liquid crystal display apparatus according to the invention.

FIG. 4 is a schematic circuit diagram of an active matrix substrate. Referring to FIG. 4, firstly all the switching transistors T1 of row V1 are turned on by the VSR (vertical shift register) and switch MOSSW1 is turned on/off by the HSR (horizontal shift register) to input a video signal to signal line H1 so that the video signal is written onto pixel electrode M11 comprising liquid crystal E1 and holding capacitance C1. Subsequently, video signals are sequentially input to respective signal lines H2 and H3 and written onto respective pixel electrodes M12, M13. When the operation of writing signals is over on row V1, it proceeds to row V2 and then to row V3 to complete the operation for the image of a frame. Normally, the polarity of the video signals being written is inverted regularly and cyclically on a field period by field period basis as shown in FIG. 5A in order to avoid sticking.

Figures 5A, 5B, 6:
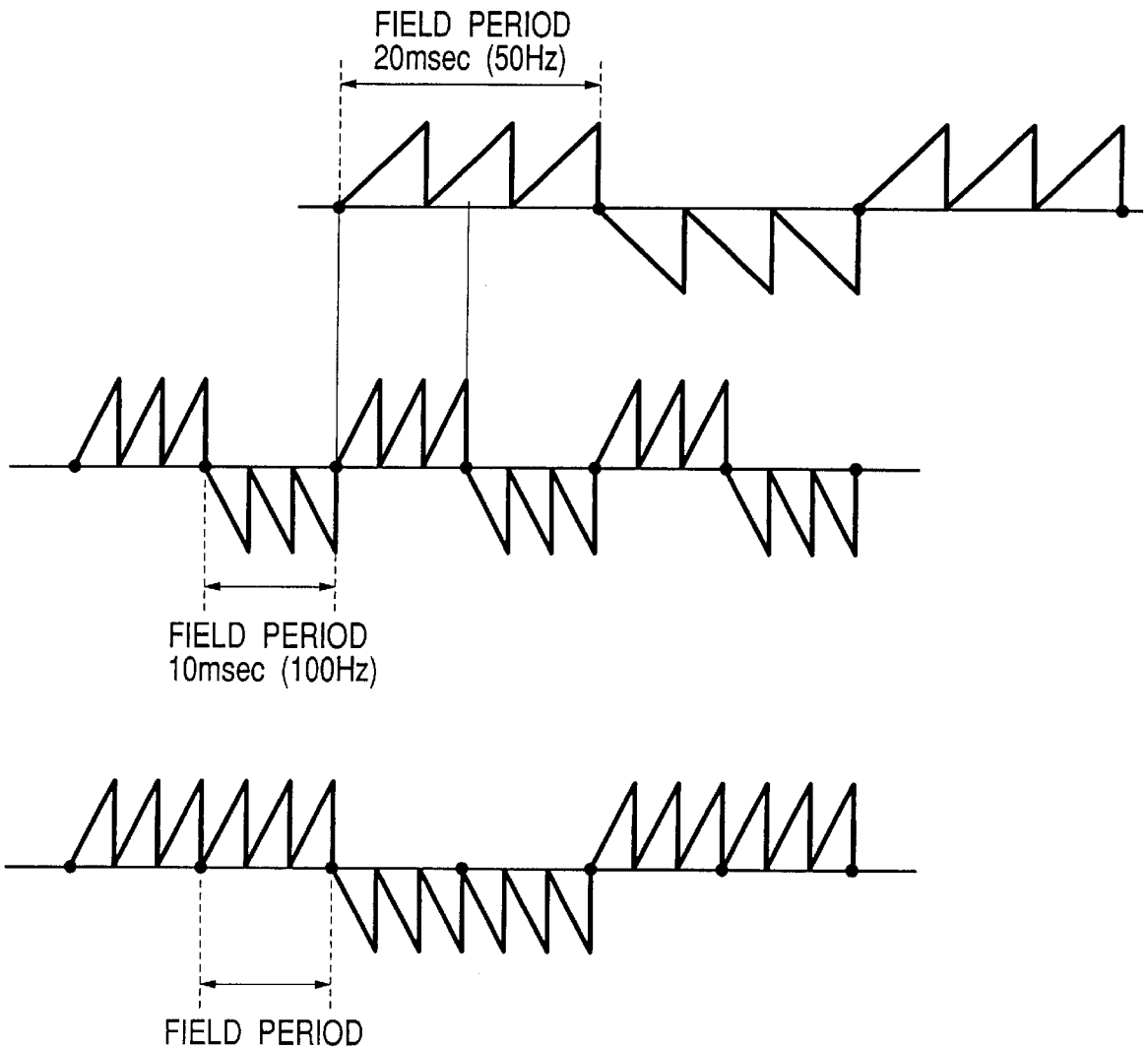
FIGS. 5A and 5B show two different modes of utilization of a video signal that are interchangeable in a liquid crystal display apparatus according to the invention.
FIG. 6 shows a mode of utilization of a video signal that can be selectively used in a liquid crystal display apparatus according to the invention.

When the field frequency is doubled for an input video signal having a frame rate of 50 Hz (or a period of 20 msec) shown in FIG. 5A by means of a frame rate conversion means 16 to produce a frame rate of 100 Hz (a period of 10 msec), flicker, if any, would not be recognized by the human eye if the counter potential of the counter electrode arranged vis-a-vis the pixel electrodes is displaced from the center of the amplitude of the pixel potential.

However, if the counter potential of the counter electrode arranged vis-a-vis the pixel electrodes is displaced from the center of the amplitude of the pixel potential, a DC voltage is applied to the liquid crystal to give rise to sticking. Therefore, the counter potential has to be regulated somehow. However, since the video signal has a short field period and flicker, if any, cannot be recognized by the human eye, such a regulating operation cannot be conducted by relying on the human eye.

Therefore, according to the invention, the video signal is transformed to make it possible to regulate the counter potential by means of the human eye. More specifically, referring now to FIG. 7, the video signal from video signal source 11 is boosted by amplifier 12 and then sent to panel 14 by way of a frame rate conversion means 16 and a polarity inversion circuit 13. The polarity inversion circuit 13 is a circuit for preparing positive and negative write signals and the inversion period is controlled by an inversion period control unit 15. Thus, the signal shown in FIG. 5B can be transformed into a signal as shown in FIG. 6. While the signal of FIG. 5B shows a regularly and cyclically changing polarity of positive, negative, positive, negative, . . . and so on, that of FIG. 6 shows a changing polarity of positive, positive, negative, negative, positive, positive, negative, negative, . . . and so on. If the counter potential is displaced from its proper level, the signal in FIG. 5B flickers at every field, whereas the signal of FIG. 6 at every two field. In other words, the flickering period of the signal of FIG. 6 can be doubled from that of the signal in FIG. 5B without changing the drive speed simply by transforming the signal. If the flicker of the transformed signal is visually recognizable, then the counter potential can be regulated by means of the human eye. The flicker will become more visually recognizable when its frequency is further reduced by changing the polarity by every three or more than three field periods. Then, the counter potential can be regulated more accurately and reliably.

The above described mode of transforming a video signal showing a polarity changing at every field to a signal showing a polarity changing at every two or more than two fields as described above for the first embodiment is adapted to the interlace system. In the case of a non-interlace system, the video signal showing a polarity changing at every frame will have to be transformed into a signal showing a polarity changing at every two or more than two frames in order to achieve the same effect.

Second Embodiment

Figure 7:
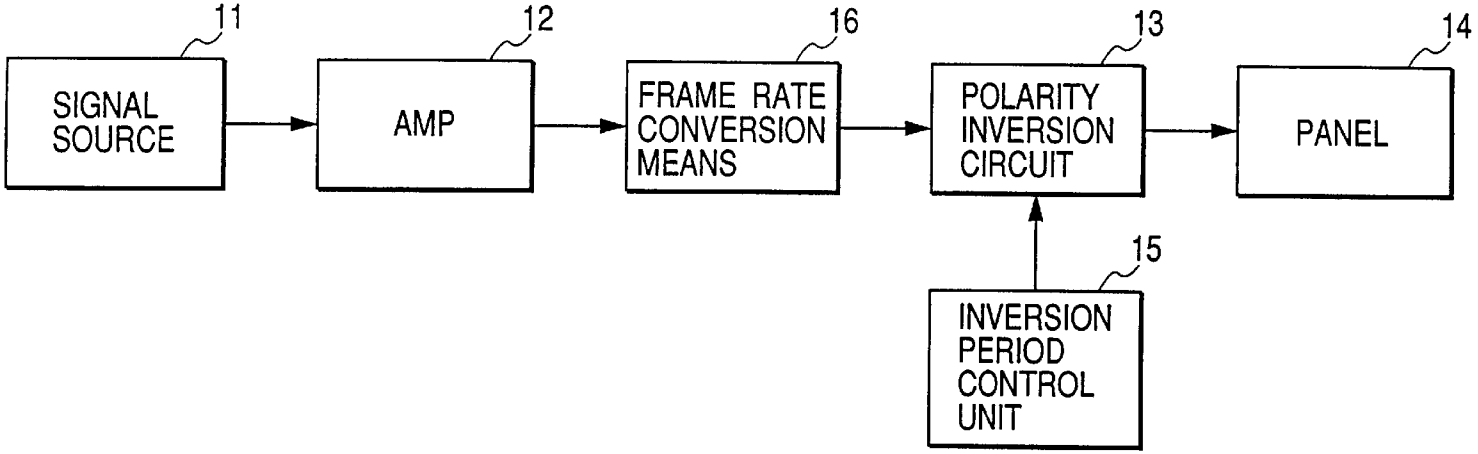
FIG. 7 is a schematic block diagram of a liquid crystal display apparatus according to the invention showing how to drive the apparatus.
Figure 8:
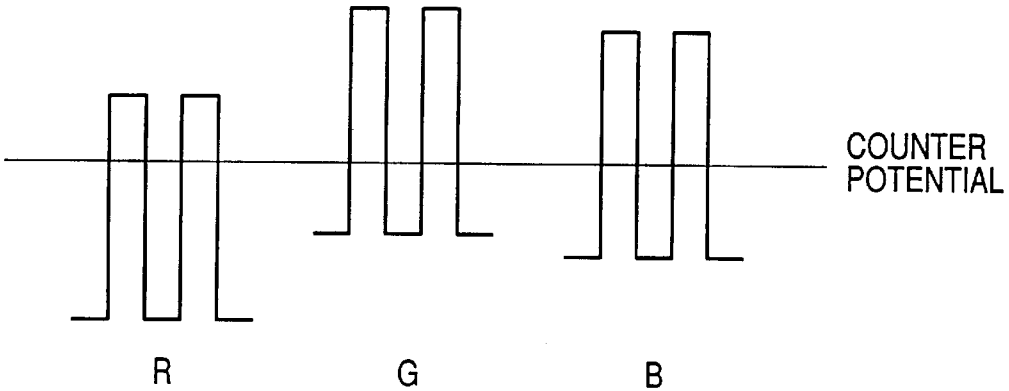
FIG. 8 shows the waveforms of signals for the three primary colors to be regulated in a liquid crystal display apparatus according to the invention.

According to the invention, the signal voltage can be regulated in a single panel type liquid crystal display apparatus comprising red (R), green (G) and blue (B) pixels regularly and cyclically arranged on a single panel. In the case of a single panel type display apparatus, the problem of sticking arises if the counter potential is located at the center of each of the R, G and B video signals of a pixel electrode so that, firstly, the centers of the R, G and B video signals have to agree with each other and, secondly, the counter potential has also to be agree with the centers. FIG. 8 shows R, G and B video signals whose centers do not agree with each other nor with the counter potential. According to the invention, the video signals and the counter potential can be regulated in a manner as described below. Note that, in the second embodiment, a video signal source 11, an amplifier 12 and a polarity inversion circuit 13 as shown in FIG. 7 are provided for each of the three primary colors of R, G and B. A single inversion period control unit 15 may be used to apply control signals to all the color systems of R, G and B or, alternatively, three inversion period control units 15 may be provided respectively for the color systems of R, G and B.

Firstly, the R video signal is transformed to show a changing polarity of positive, positive, negative, negative, positive, positive, negative negative, . . . and so on by means of a control signal from the inversion period control unit 15, while the remaining G and B video signals are held to show a changing polarity of positive, negative, positive, negative, . . . and so on or reduced to the black level, so that only flicker is visible only for red. Then, the counter potential is regulated under this condition to bring it to the level of the center of the R video signal.

Thereafter, the G video signal is transformed to show a changing polarity that changes at every two frames by means of a control signal from the inversion period control unit 15 so that flicker is visible only for green. Then, the gain of the amplifier for green is regulated under this condition, while keeping the counter potential unchanged, to make the center of the G video signal with the counter potential.

Finally, the B video signal is transformed to show a changing polarity that changes at every two frames by means of a control signal from the inversion period control unit 15 so that flicker is visible only for blue. Then, the gain of the amplifier for blue is regulated under this condition, while keeping the counter potential unchanged, to make the center of the B video signal with the counter potential. Now, the centers of the R, G and B video signals agree with each other and also with the counter potential.

While the counter potential is regulated by detecting flicker for each of the three primary colors of R, G and B in the above described embodiment, the sticking phenomenon and other problems of the liquid crystal can be avoided by transforming each video signal showing a polarity changing at every field to a signal showing a polarity changing at every two or more than two fields for each of the three color. Also, any possible generation of a DC voltage and the flicker phenomenon can be avoided by transforming each video signal into a signal showing a polarity changing at every two or more than two frames.

Third Embodiment

Figure 9:
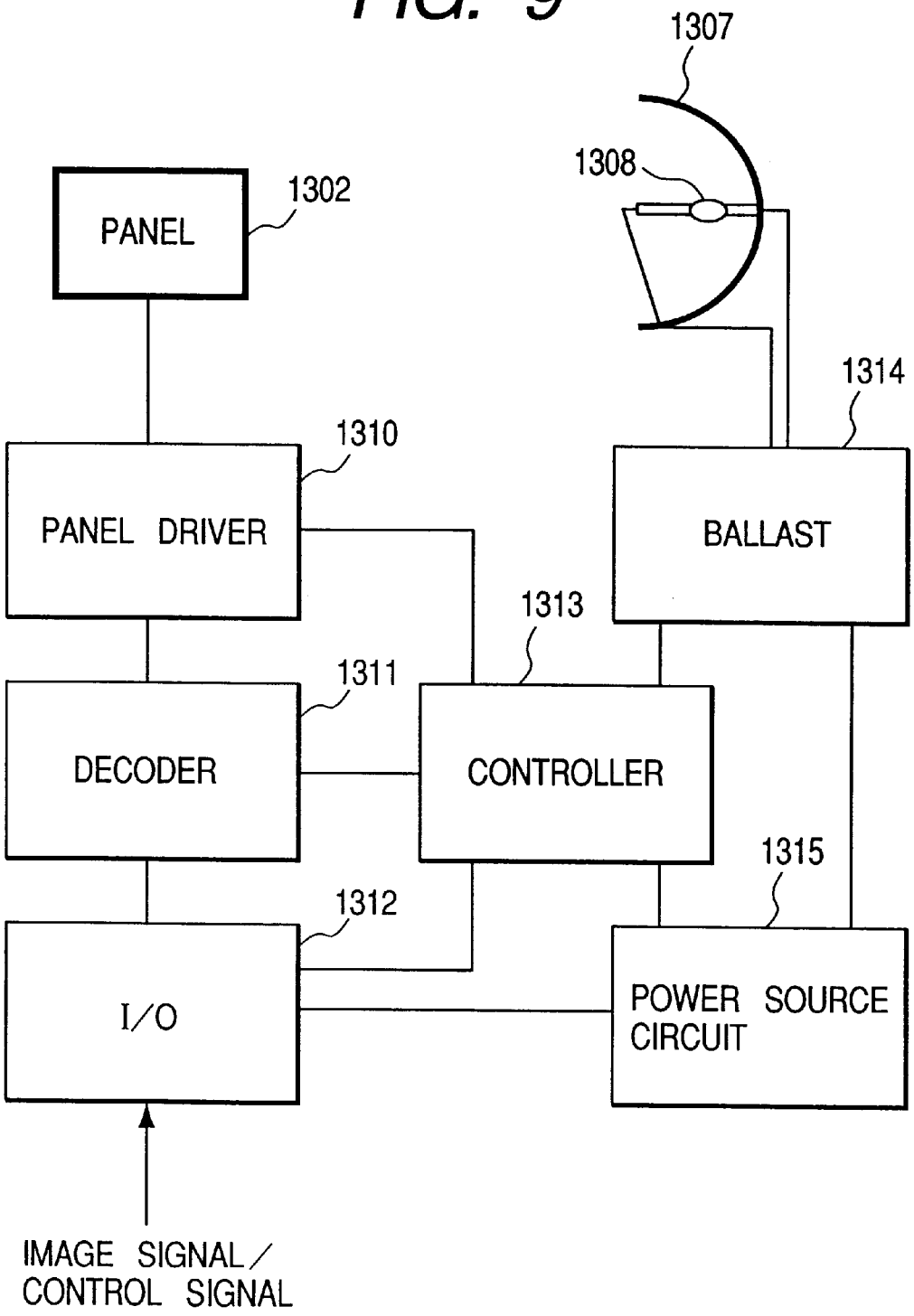
FIG. 9 is a schematic block diagram of the drive circuit of a projection type liquid crystal display apparatus according to the invention.

FIG. 9 is a schematic block diagram of the drive circuit of a projection type liquid crystal display apparatus according to the invention. In FIG. 9, reference numeral 1310 denotes a panel driver adapted to invert the polarity of RGB image signals and generate liquid crystal drive signals having a voltage amplified to a predetermined level, drive signals for driving the counter electrode and various timing signals. It is also adapted to regulate the DC level as described earlier by referring the preceding embodiments. Reference numeral 1312 denotes an interface for decoding various image signals and control transmission signals into standard image signals and other signals respectively. Reference numeral 1311 denotes a decoder and the standard image signals from the interface 1312 are then decoded and converted into image signals for the three primary colors of RGB and synchronizing signals, which are video signals adapted to the liquid crystal panel 1302. Reference numeral 1314 denotes a ballast for driving the arc lamp 1308 in elliptic reflector 1307 to turn it on and off. Reference numeral 1315 denotes a power source circuit for supplying power to the circuit blocks. Reference numeral 1313 denotes a controller comprising a control unit (not shown) for controlling the operations of the circuit blocks in a coordinated manner. Particularly, it issues instructions to the panel driver 1310 for polarity inversion, for indicating the number of fields by which the polarity is inverted to regulate the counter potential and for selecting the color to be used for the regulating operation. Thus, a projection type liquid crystal display apparatus according to the invention comprises a single panel type projector having a drive circuit system for illuminating the liquid crystal panel 1302 with white light from the arc lamp 1308 such as a metal halide lamp and projecting the video signals of the reflection type liquid crystal panel 1302 onto a large screen by way of an optical lens system (not shown) to display large images. Since a liquid crystal display apparatus according to the invention is free from flicker and a sticking phenomenon of the liquid crystal panel, it can display large and high quality images on the display screen.

What is claimed is:

1. A liquid crystal display apparatus comprising:

a liquid crystal panel having a circuit substrate carrying thereon a plurality of pixel electrodes, a counter substrate carrying thereon a corresponding counter electrode disposed facing the pixel electrodes and a liquid crystal layer held between the circuit substrate and the counter substrate;

a driving circuit for applying a voltage between said circuit substrate and said counter substrate; and control means for outputting a video signal to said liquid crystal panel for performing a display by said liquid crystal panel, wherein said control means comprises a switching means for changing over from an inversion of the polarity of the video signal per every one field to an inversion of the polarity of the video signal per every n fields (n being a positive integer not equal to 1) or vice versa, and controls said switching means so as to change the video signal of which polarity is inverted per every one field to the video signal of which polarity is inverted per every n fields during adjustment of a potential of said counter electrode.

2. A liquid crystal display apparatus according to claim 1, wherein said control means comprises a polarity inverting circuit for inverting the polarity of the video signal input to said liquid crystal panel and an inversion period control means for controlling the timing of inversion of said polarity inverting circuit, and a switching means responding to an output from said inversion period control means to change over between the inversion per every one field and the inversion per every n fields or vice versa.

3. A liquid crystal display apparatus comprising:

a liquid crystal panel having a circuit substrate carrying thereon a plurality of pixel electrodes, a counter substrate carrying thereon a corresponding counter electrode disposed facing the pixel electrodes and a liquid crystal layer held between the circuit substrate and the counter substrate;

a driving circuit for applying a voltage between said circuit substrate and said counter substrate; and control means for outputting a video signal to said liquid crystal panel for performing a display by said liquid crystal panel, wherein said control means comprises a switching means for changing over from an inversion of the polarity of the video signal per every one frame to an inversion of the polarity of the video signal per every n frames (n being a positive integer not equal to 1) or vice versa, and controls said switching means so as to change the video signal of which polarity is inverted per every one frame to the video signal of which polarity is inverted per every n frames during adjustment of a potential of said counter electrode.

4. A liquid crystal display apparatus according to claim 3, wherein said control means comprises a polarity inverting circuit for inverting the polarity of the video signal input to said liquid crystal panel and an inversion period control means for controlling the timing of inversion of said polarity inverting circuit, and a switching means responding to an output from said inversion period control means to change over between the inversion per every one frame and the inversion per every n frames or vice versa.

* * * * *